US006371358B1

(12) United States Patent
Virginio et al.

(10) Patent No.: US 6,371,358 B1
(45) Date of Patent: Apr. 16, 2002

(54) METHOD AND PLANT FOR ROLLING MULTIPLE BILLETS FED FROM A BILLET-HEATING FURNACE SET UPSTREAM OF A ROLL TRAIN

(75) Inventors: Pometto Virginio, Bovisio Masciago; Colombo Enrico, Milan, both of (IT)

(73) Assignee: Techint Compagnia Tecnica Internazionale S.p.A., Milan (IT)

( * ) Notice: Subject to any disclaimer, the term of this patent is extended or adjusted under 35 U.S.C. 154(b) by 0 days.

(21) Appl. No.: 09/604,036

(22) Filed: Jun. 27, 2000

(30) Foreign Application Priority Data

Jun. 30, 1999 (IT) ..... MI99A1437

(51) Int. Cl.[7] ..... B21D 39/00
(52) U.S. Cl. ..... 228/158; 228/171; 228/5.7
(58) Field of Search ..... 228/158, 155, 228/164, 170, 171, 212, 507, 13, 15.1, 44.3, 47.1; 219/610, 611, 617, 614, 57, 97, 99, 101, 107; 72/202, 342.1; 29/336

(56) References Cited

U.S. PATENT DOCUMENTS 2,214,618 A * 9/1940 Kenyon et al.
4,018,376 A * 4/1977 Capetti
5,787,565 A * 8/1998 Matsuo et al.
5,829,117 A * 11/1998 Okawa et al.
5,931,370 A * 8/1999 Poloni et al.
5,957,367 A * 9/1999 Matsuo et al.
5,994,665 A * 11/1999 Nishibayashi et al.
6,041,993 A * 3/2000 Matsuo et al.
6,089,441 A * 7/2000 Matsuo et al.
6,116,496 A * 9/2000 Matsuo et al.

FOREIGN PATENT DOCUMENTS

| | | |
|---|---|---|
| EP | 0761330 | 3/1997 |
| EP | 0806254 | * 12/1997 |
| EP | 0832700 | * 4/1998 |
| JP | 53129151 | * 11/1978 |
| JP | 53135863 | * 11/1978 |

* cited by examiner

*Primary Examiner*—Tom Dunn
*Assistant Examiner*—Colleen P. Cooke
(74) *Attorney, Agent, or Firm*—Hedman & Costigan, P.C.

(57) ABSTRACT

The invention regards a method for rolling billets fed from a billet-heating furnace (10) set upstream of a roll train, in which, between the furnace (10) and a first stand (11) of the roll train is provided a space for transfer of the billets coming out of the furnace. In the space between the furnace (10) and the stand (11) at least two billets (15, 14) are welded together and subsequently introduced into said stand (11).

5 Claims, 11 Drawing Sheets

Figure 1:
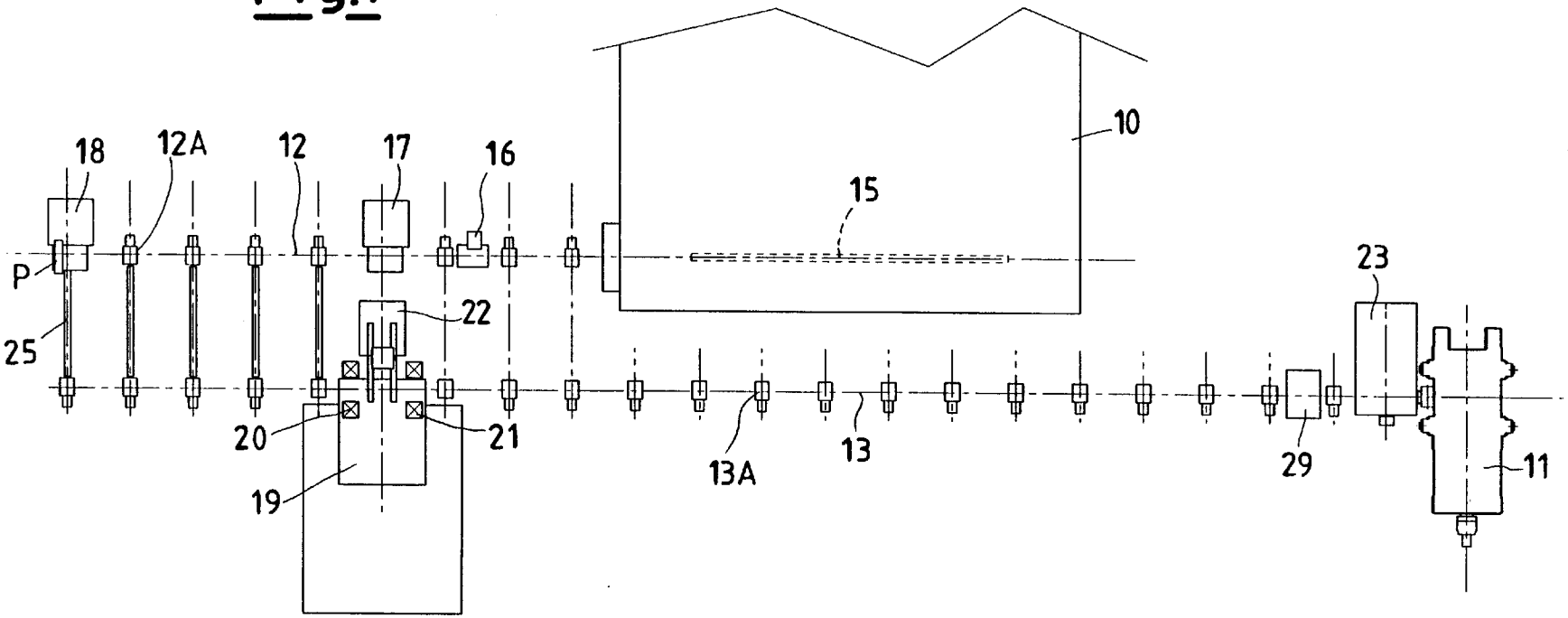

METHOD AND PLANT FOR ROLLING MULTIPLE BILLETS FED FROM A BILLET-HEATING FURNACE SET UPSTREAM OF A ROLL TRAIN

The present invention refers to a method for non-continuous rolling of multiple billets fed from a billet-heating furnace set upstream of a roll train. The invention also refers to a plant which is particularly suitable for the implementation of said method.

As is known to the persons skilled in the branch, there are two methods generally adopted for rolling the billets coming out of a billet-heating furnace which is set upstream of a roll train, aligned with the latter. The first method is discontinuous, whilst the second method is continuous.

In discontinuous methods, the billets are fed, one at a time, into the roll train, at time intervals which, for reasons of productivity, must be as short as possible, for example around 5 seconds.

Discontinuous rolling methods have by now experienced a consolidated use over time and have a plant cost lower than that of continuous methods. They present, however, a number of drawbacks. First of all, for each billet, evidently a feeding-in is required between the cylinders of each roll stand making up the roll train. There thus exists a high risk of jamming, with consequent stoppage of the plant and waste of material. A high degree of wear of the rolls and of the devices for feeding the billets in between them is moreover to be expected, given the high number of feed-ins. In addition, for each billet, a head-cropping operation is required, with consequent wear on the blades of the billet shear and waste of material.

Continuous methods, instead, envisage rolling of a continuous billet which is obtained by welding the head of one billet coming out of the heating furnace to the tail of the billet that came out before it and is already introduced into the first stand of the roll train, and so forth.

Continuous rolling methods require more costly plants than discontinuous methods and are particularly justified for high levels of output.

Continuous rolling methods are, for instance, described, in the patents EP-0761330 and EP-0832700, to which the reader is referred if further clarifications were necessary.

The general purpose of the present invention is to overcome the drawbacks of the prior art by providing a method for rolling billets coming out of a heating furnace, which, albeit having contained plant costs, i.e., lower than those involved in a continuous method, enables an output greater than that of discontinuous methods.

Another purpose of the invention is to make available a rolling method that is easy to implement also by modifying already existing plants.

A further purpose of the invention is to provide a method that enables rolling also of short billets, for example ones having a length of 4.6 m, which are difficult to use in continuous methods, in that their rolling time may be shorter than the time of the welding cycle.

The above purposes are achieved by a method and plant having the characteristics specified in the attached claims.

The structural and functional characteristics of the present invention, as well as its advantages as compared to the prior art, will emerge even more clearly and evidently from an examination of the ensuing description referring to the attached schematic drawings, which show an example of plant for the implementation of the new and original ideas of the present invention. In the drawings:

FIG. 1 is a schematic plan view illustrating a plant suitable for the implementation of the method according to the invention; and FIGS. 2–11 are views illustrating the plant of FIG. 1 in the succession of the various operating steps of the rolling method according to the invention.

In FIG. 1 of the drawings, a billet-heating furnace is designated by 10, and the first stand of a roll train is designated by 11. The reference number 12 designates the axis of exit of the billets from the furnace, and 13 the axis of rolling.

As may be clearly seen in the schematic drawings, according to a characteristic of the invention the said axes 12, 13 are staggered by a desired amount and are parallel to one another.

The path of the billet coming out of the furnace 10 in the direction of the stand 11 is of such a length as to enable—in the time interval identified— welding of at least two billets together, i.e., welding of the head of one billet 14 coming out of the furnace 10 to the tail of a billet 15 that came out previously, whether the billets are short or long.

Welding of the head of the billet 14 to the tail of the billet 15 is performed by means of a series of operating units cascaded between the furnace 10 and the stand 11, according to a layout and to operating procedures that are innovative as compared to the known art.

More precisely, set downstream of the furnace 10 are in succession: a descaler 16, a pair of interspaced cropping devices 17, 18, a fixed (stationary) welding machine 19, which is provided with two pairs of welding yokes 20, 21 set opposite to each other, respectively upstream and downstream, a fixed (stationary) deburrer 22, and a possible emergency billet shear 23.

Upstream of the emergency billet shear 23, if necessary a billet-heating system 29 may be provided, such as an induction coil or a burner furnace.

Since the above-mentioned operating units can be of any type well known to the persons skilled in the branch, they are not described herein in greater detail.

As has already been said, FIGS. 2–11 illustrate the sequence of the operating steps of the rolling method according to the invention, which envisages welding of the head of one billet 14 coming out of the furnace to the tail of one billet 15 that came out of the furnace before, in a way which is different and innovative as compared to the techniques up to now adopted.

The operating steps described, merely to provide a non-limiting example, with reference to FIGS. 2–11, regard welding of only two billets together. However, the method and plant according to the invention can likewise be applied to the welding of a number of billets greater than two, i.e., three or more.

Figure 4:
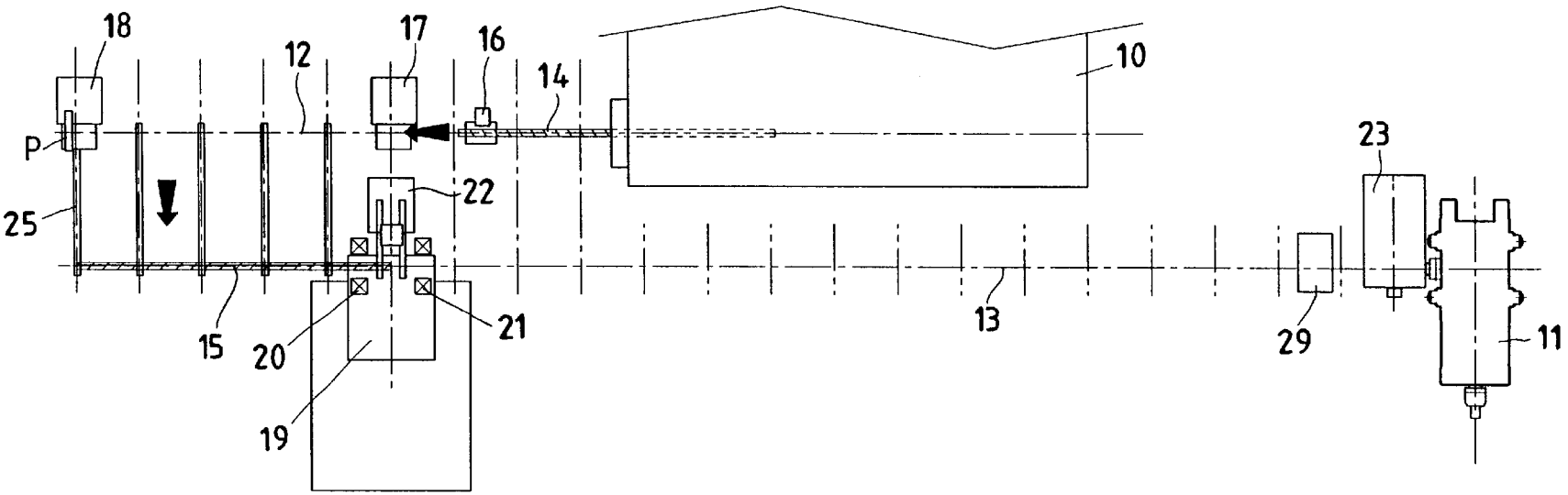

More precisely, while a billet 15 that has already come out of the furnace is proceeding along the rolling axis 13, another billet 14 comes out of the furnace along the axis 12 of exit from the furnace, which is different from the rolling axis 13 (FIG. 4).

With reference to FIGS. 2–11, there follows a description of the succession of the operating steps to which the billets 15, 14 are subjected until they are welded together to be then fed into the rolling train.

Figure 2:
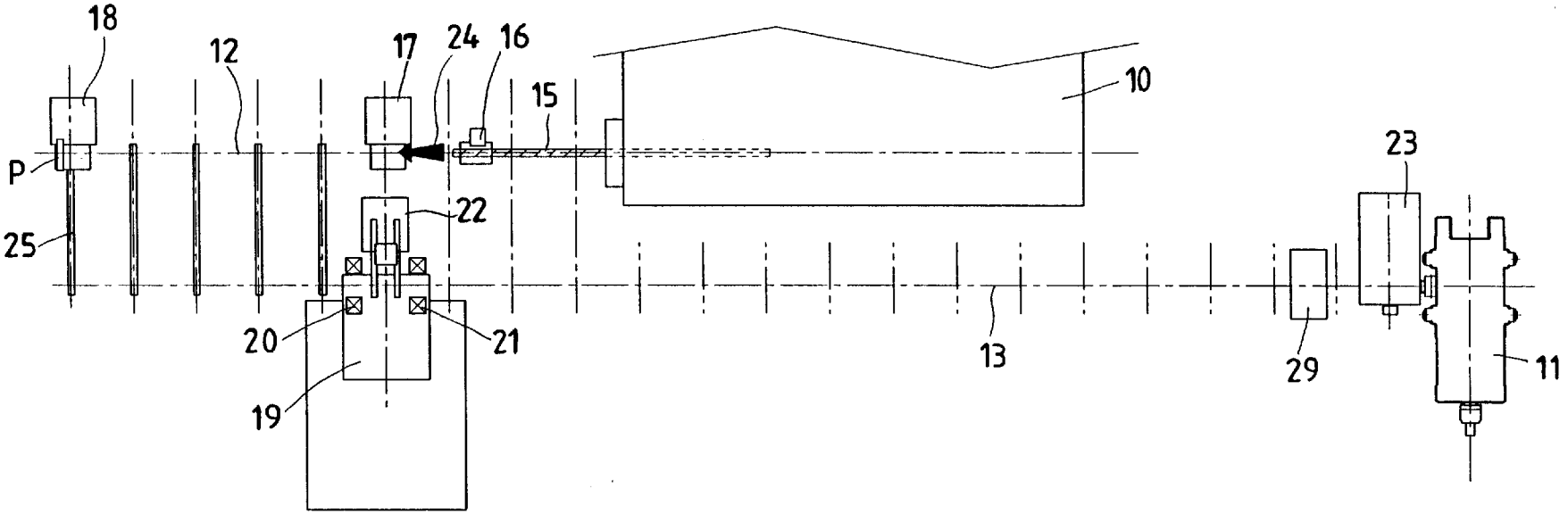
Figure 3:
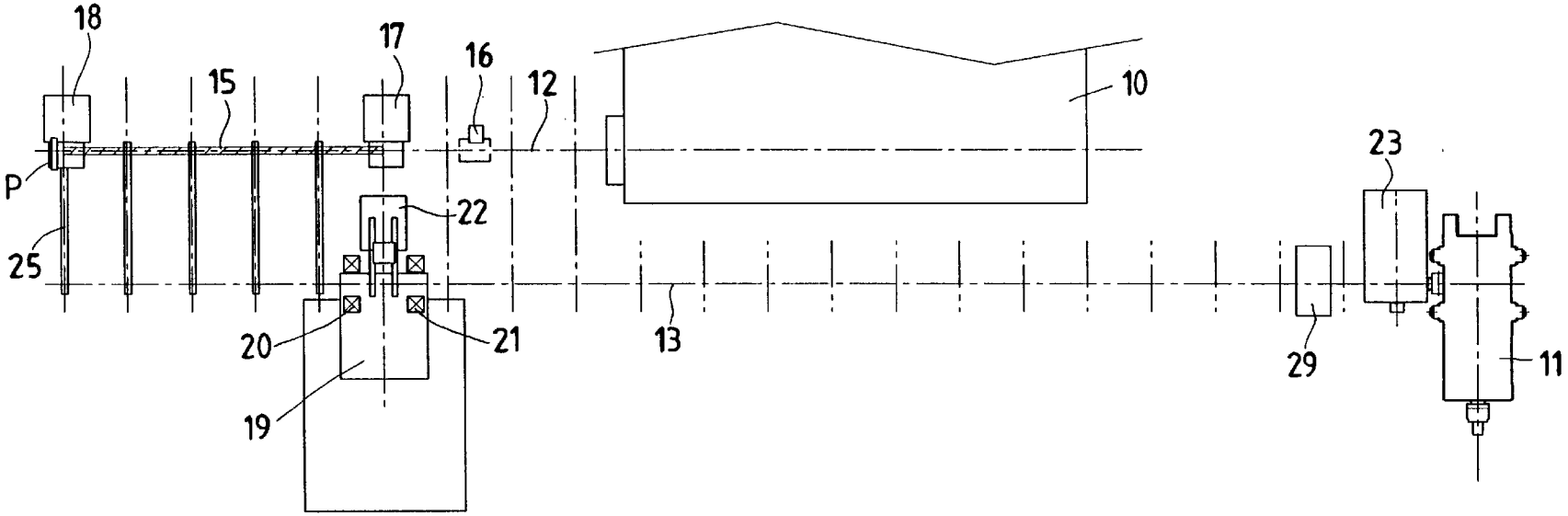

In FIGS. 2 and 3 of the drawings it may be seen how the billet 15 that has come out of the furnace 10 along the axis 12 is made to advance, via the roller way 12A, in the direction of the arrow 24, until it comes up and stops against the barrier P (FIG. 3), with its head and tail in points corresponding to the cropping devices 17, 18, which perform simultaneous cropping of the head and tail.

The cropped billet 15 is transferred, by any type of conveyor illustrated schematically in 25, from the axis 12 of exit from the furnace to the rolling axis 13 (FIG. 4). When the billet 15 is in this condition on the rolling axis 13, the furnace 10 is sending out the subsequent billet 14.

Figure 5:
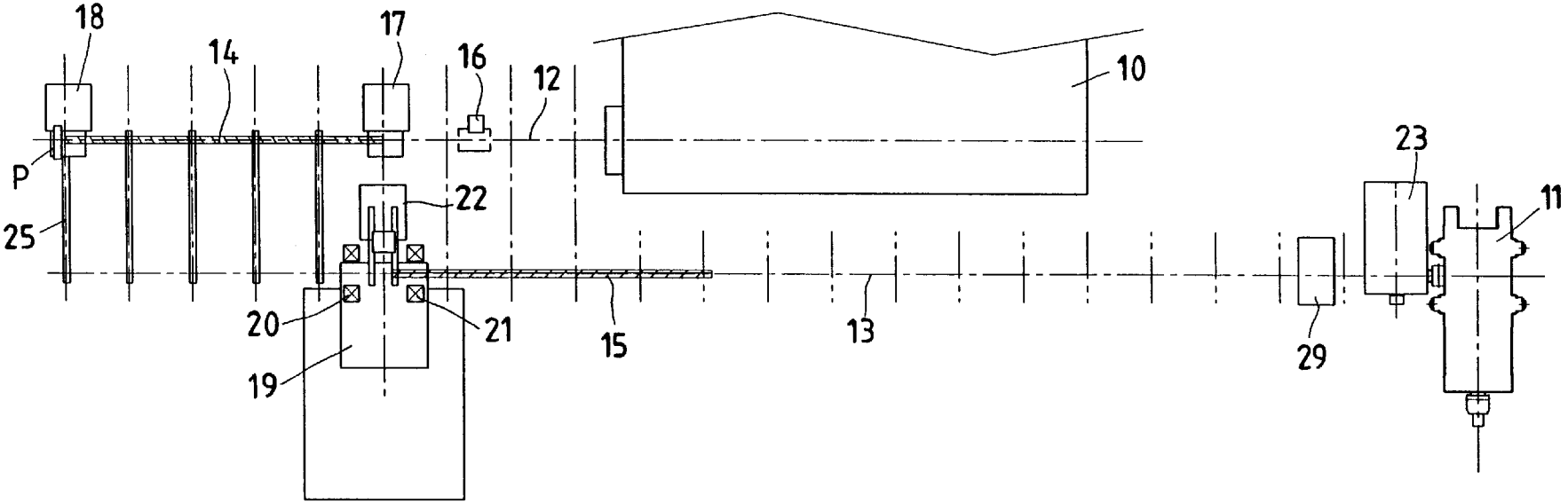

The billet 15, via the roller way 13A, is made to advance from the position of FIG. 4 to the position of FIG. 5, and here it is stopped with its tail at the welding yokes downstream 21, which are open, as are the welding yokes upstream 20. During this travel of the billet 15, the billet 14 that has come out of the furnace comes up to and stops against the barrier P, and is cropped at both its ends by the cropping devices 17, 18.

Figure 6:
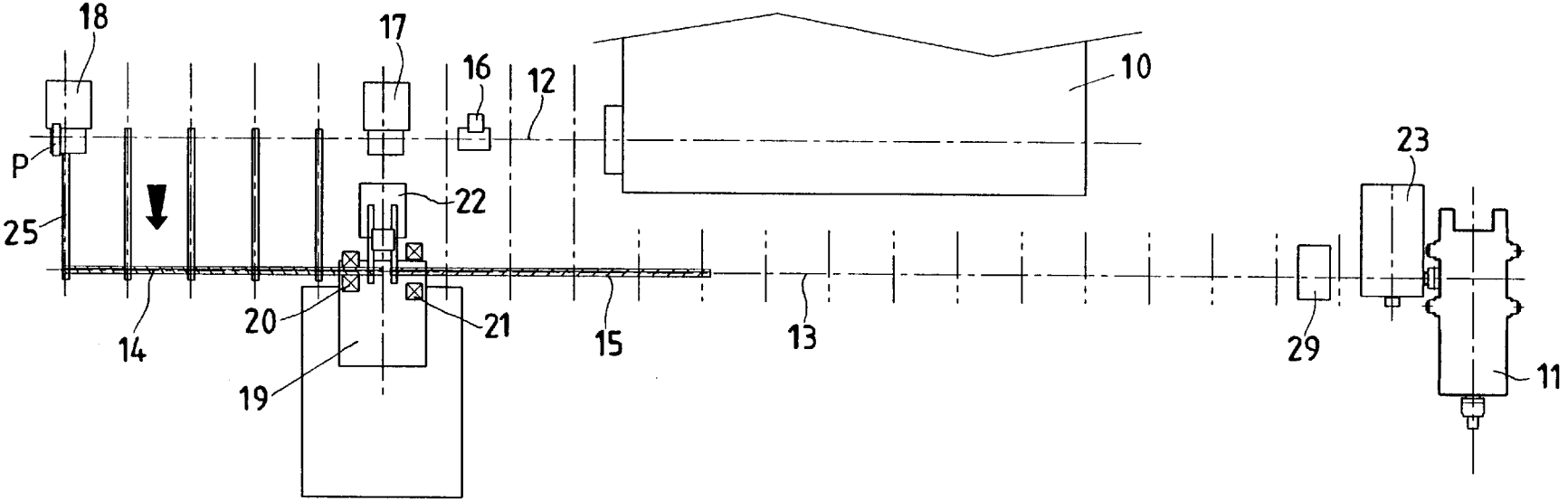
Figure 7:
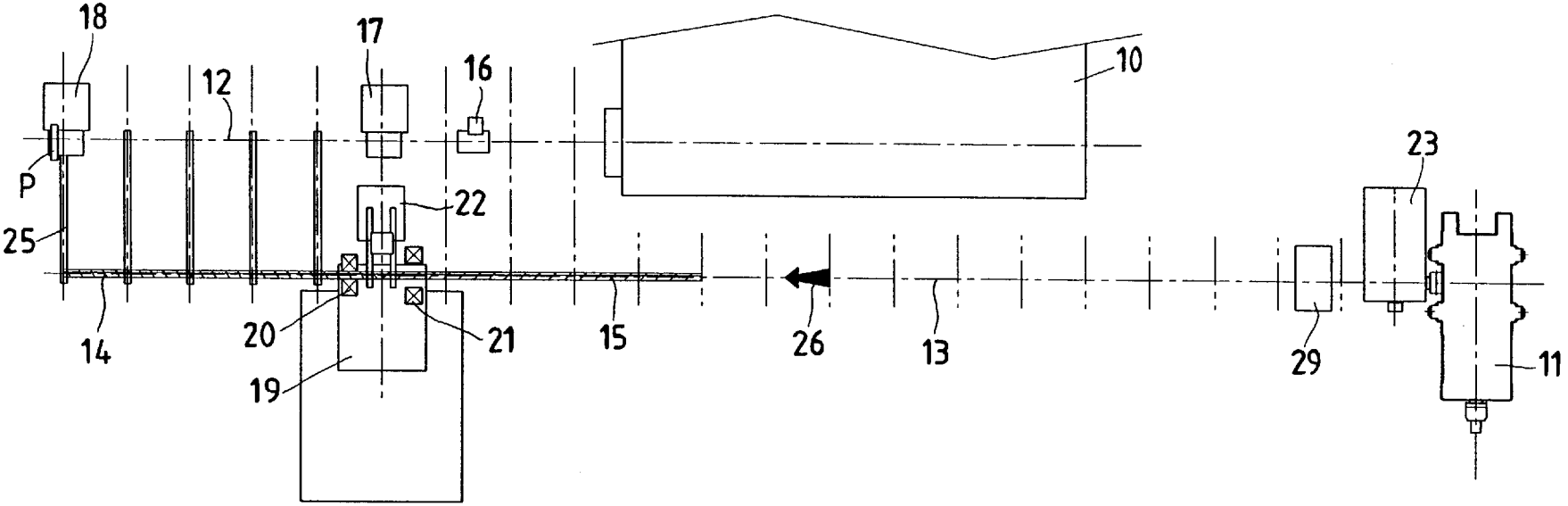

With the billet 15 in the stationary waiting position shown in FIG. 5, and with the yokes 20, 21 of the welding machine 19 in the open condition, the billet 14 is translated from the position of FIG. 5 (on the axis 12 of exit from the furnace) to the position of FIG. 6 (on the rolling axis 13). In the position of FIG. 6, the billet 15 is always stationary, awaiting the billet 14, with the yokes 21 open, whilst the yokes 20 close on the head of the billet 14, which is also by now stationary.

With the billet 14 in this stationary position, the billet 15, via the roller way 13A, is translated backwards, in the direction of the arrow 26, until its tail comes up against the head of the billet 14, which is stationary.

Figure 8:
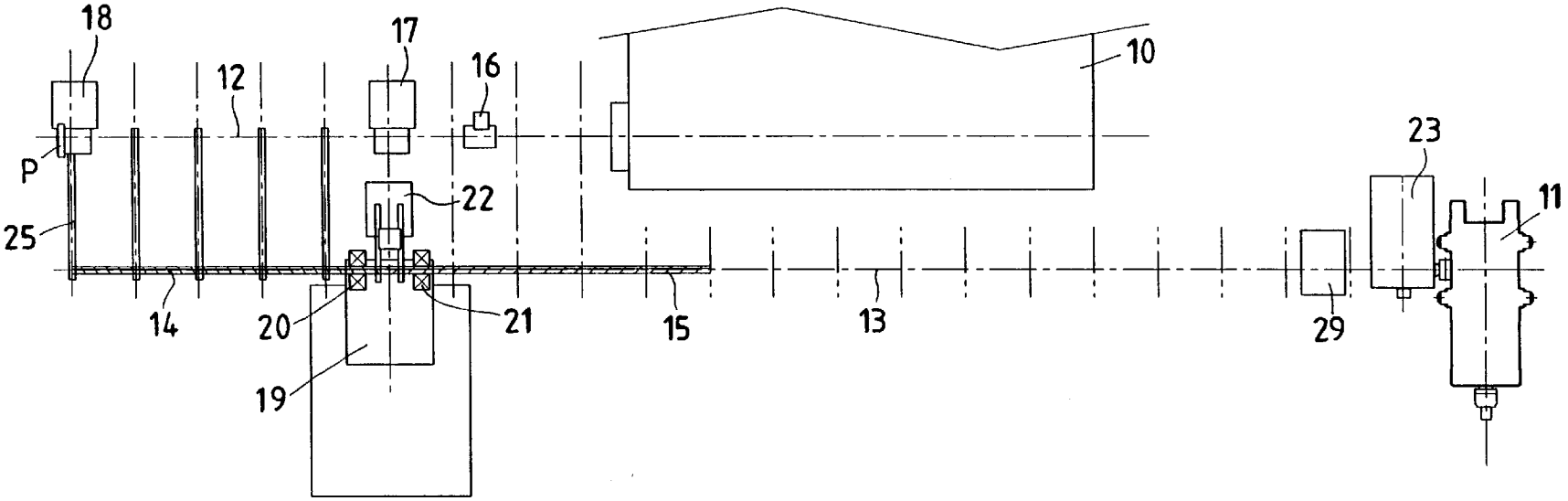

With the billets 14, 15 in this stationary condition, head-to-tail butt-welding is performed by the closing of the yokes 21 on the tail of the billet 15 (FIG. 8).

Figure 9:
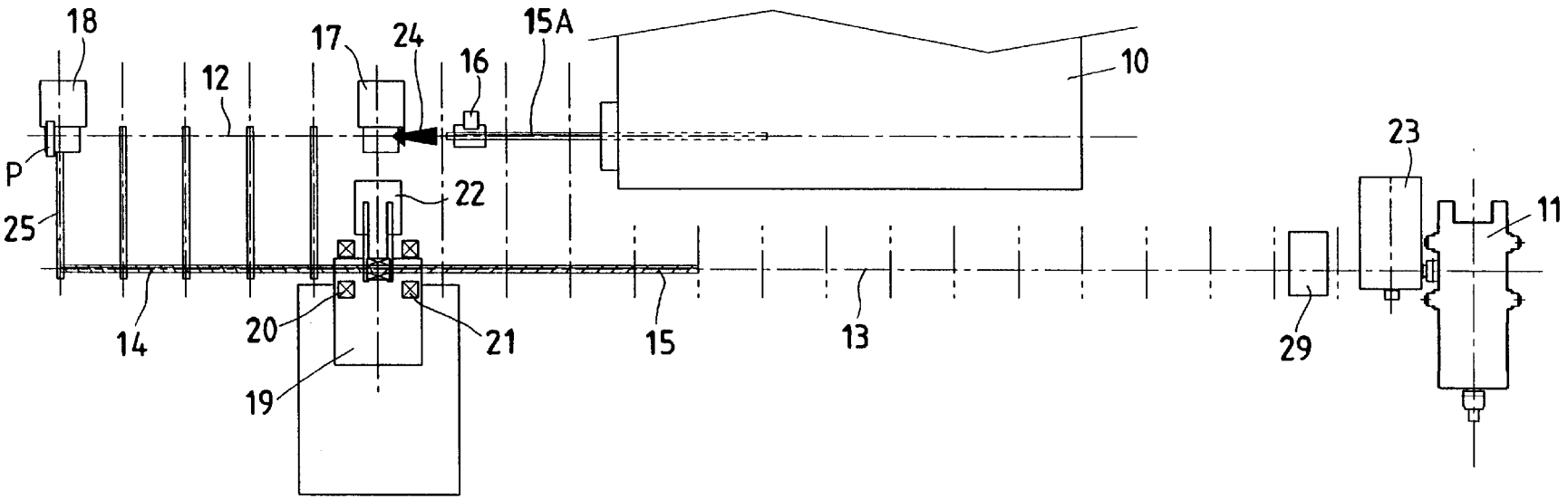
Figure 10:
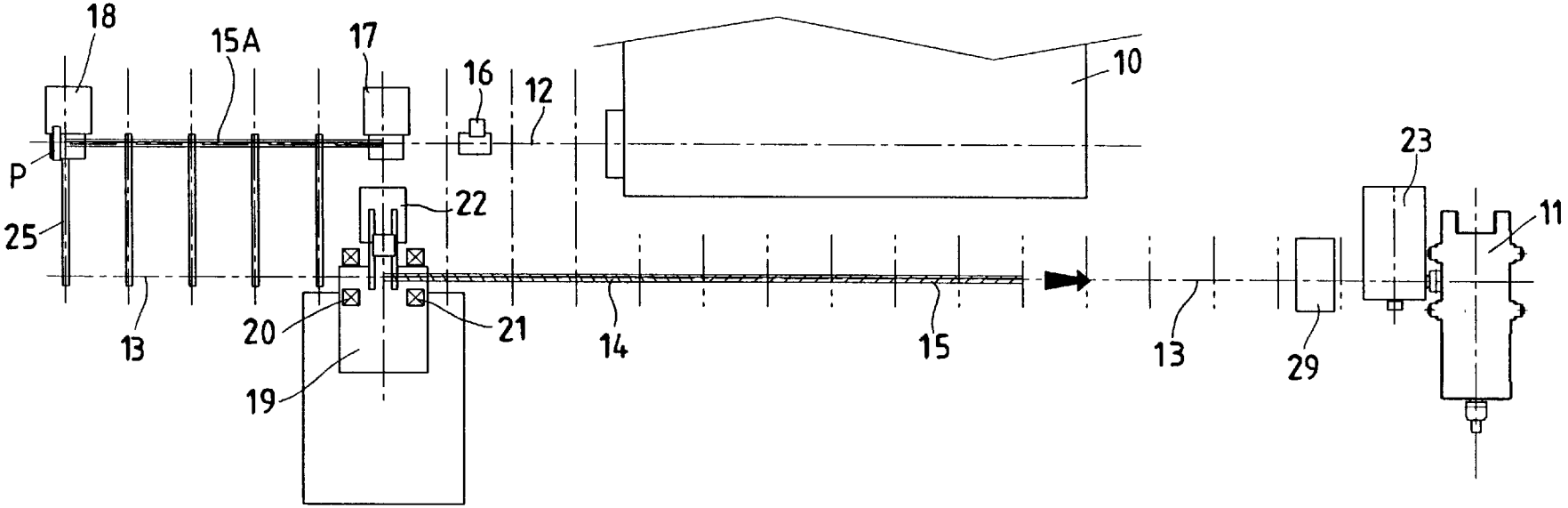
Figure 11:
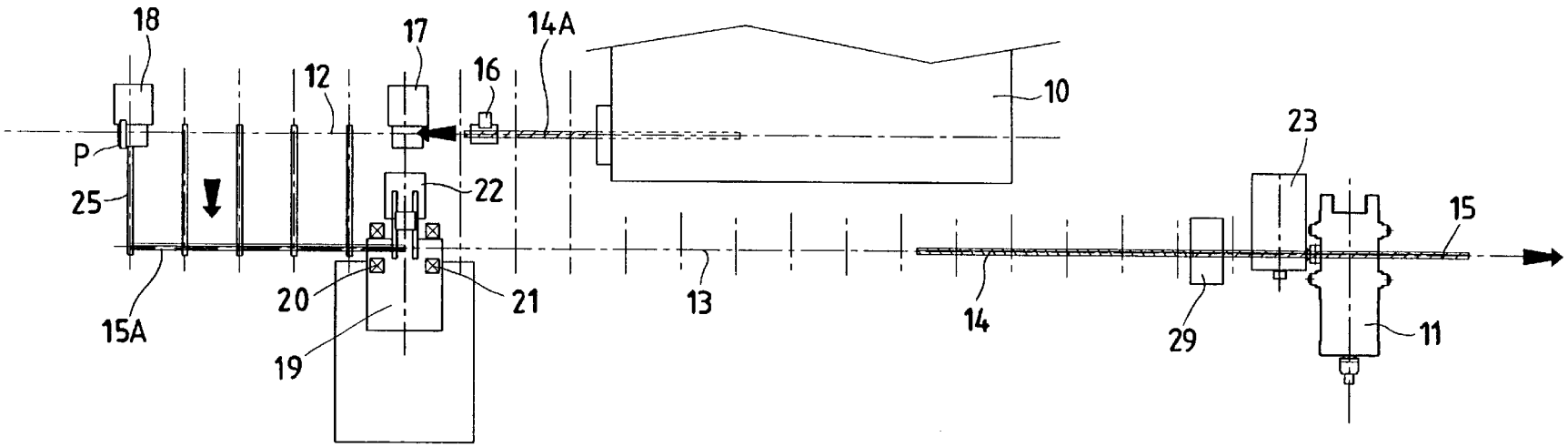

Next, the yokes 20, 21 are opened, as shown in FIG. 9, while the furnace 10 is sending out another billet 15A. At the same time the deburrer 22 intervenes, which eliminates the burrs in the welded area.

The billets 14, 15 that have been welded together, via the roller way 13A, are finally fed into the first stand 11 of the roll train (FIGS. 10, 11), and at the same time the billet 15A has been transferred from the exit-from-furnace line 12 to the rolling line 13, and the furnace 10 is sending out another billet 14A (FIG. 11) to give rise to another operating cycle, and so forth.

The advantages of the method and plant according to the invention may be summarized as follows:

- plant costs lower than those involved in a continuous method, and a higher productivity than in known discontinuous methods; in particular, since the welding machine is fixed, no cost is envisaged for complex moving devices, as in the case of mobile welding machines used in continuous methods;
- possibility of modifying already existing plants of the discontinuous type;
- possibility of processing both short billets and long billets, for example from 4 to 12 m;
- longer service life of the rolling cylinders and of the corresponding equipment;
- longer service life of the billet shears;
- less waste of material; and
- easy management of the welding process, in that the operation is carried out with the billets stationary, using a fixed welding machine.

Furthermore, the discontinuous method according to the invention is more suited than a continuous method for managing small batches of materials which have different compositions from one another.

In this way, the purposes mentioned in the preamble of the description are achieved.

The scope of the invention is defined by the ensuing claims.

What is claimed is:

1. A non-continuous rolling method for billets comprising:

feeding at least two billets from a billet-heating furnace set upstream of a roll train, between the furnace and a first stand of the roll train space is provided for transfer of the billets coming out of the furnace;

transferring the second billet from the axis of exit from the furnace to the rolling axis while the first billet is in a stationary waiting position on the rolling axis, downstream of the welding machine;

precisely gripping the head of the second billet by yokes that are upstream of the welding machine;

drawing the first billet back so as to bring its tail against the head of the second billet;

closing of the yokes downstream on the tail of the first billet; thereby welding together at least a first and a second billet in said space between the furnace and the stand;

carrying out said welding on a rolling axis which is staggered with respect to an axis of exit of the billets from the furnace, and with said billets in a stationary condition;

deburring a welded area of said welded head and tail;

heating said welded billets; and feeding said welded billets into the first stand of the roll train.

2. A method according to claim 1, wherein before transfer from the axis of exit to the rolling axis, the two billets that have been welded together coming out of the furnace are stopped, and a front end portion and a rear end portion of said billets are cropped.

3. A method according to claim 2, wherein said billets are descaled before being stopped.

4. A plant for implementation of the method as in any of the preceding claims, downstream of the furnace, cascaded and combined together comprising: a descaler, a pair of interspaced cropping devices, an arrest device (P), a stationary welding machine, which is provided with two pairs of yokes set opposite to each other, respectively upstream and downstream, a stationary deburrer, and a conveyor for transferring the billets from the axis of exit from the furnace to the rolling axis, respective roller ways being provided on said axes.

5. A plant according to claim 4, further comprising a heating system provided upstream of an emergency billet shear for rendering the temperature of the welded billets uniform before feeding said billets into the first stand.

* * * * *